US009399002B2

(12) United States Patent
Bianco

(10) Patent No.: US 9,399,002 B2
(45) Date of Patent: Jul. 26, 2016

(54) GRIPPING MEMBER OF A BAG FOR PHARMACEUTICAL PRODUCTS

(75) Inventor: Walter Bianco, Trieste (IT)

(73) Assignee: Health Robotics S.r.l., Bolzano (IT)

( * ) Notice: Subject to any disclaimer, the term of this patent is extended or adjusted under 35 U.S.C. 154(b) by 981 days.

(21) Appl. No.: 13/475,160

(22) Filed: May 18, 2012

(65) Prior Publication Data

US 2013/0308879 A1 Nov. 21, 2013

(51) Int. Cl.

| | |
|---|---|
| ***B65D 33/06*** | (2006.01) |
| ***A61J 1/10*** | (2006.01) |
| ***B65B 43/46*** | (2006.01) |
| *A61J 1/16* | (2006.01) |
| *A61J 1/14* | (2006.01) |
| *B65B 3/00* | (2006.01) |

(52) U.S. Cl.

CPC ..... *A61J 1/10* (2013.01); *B65B 43/465* (2013.01); *A61J 1/1462* (2013.01); *A61J 1/1475* (2013.01); *A61J 1/16* (2013.01); *B65B 3/003* (2013.01)

(58) Field of Classification Search

CPC ..... B25B 27/02; Y10T 24/4453; Y10T 24/44538; F16B 2/10; B65B 43/465; B65D 33/06; B31B 41/00

USPC ..... 269/237, 128; 383/13; 81/418; 606/148; 72/371, 372; 140/102, 105, 106; 24/517, 504, 520, 666

See application file for complete search history.

(56) References Cited

U.S. PATENT DOCUMENTS 1,546,989 A * 7/1925 Morris ..... B25B 7/02 72/409.16
3,171,184 A * 3/1965 Posse ..... F16K 7/063 24/518
3,837,633 A * 9/1974 Paulsen ..... B01L 9/06 24/517
4,345,600 A * 8/1982 Rothfuss ..... A61B 17/04 606/148
5,417,701 A * 5/1995 Holmes ..... A61B 17/0469 606/147
5,464,413 A * 11/1995 Siska, Jr. ..... A61B 17/122 606/151
5,839,141 A * 11/1998 Hermann ..... A01K 97/00 7/106
5,947,982 A * 9/1999 Duran ..... A61B 17/0625 606/139
6,641,562 B1 * 11/2003 Peterson ..... A61M 5/14244 604/132
7,814,817 B1 * 10/2010 Sheriff ..... B25B 7/02 140/102.5
8,020,825 B2 * 9/2011 Dostaler ..... A47G 23/0225 24/332
8,539,989 B2 * 9/2013 Giribona ..... B65B 3/003 141/2
8,821,471 B2 * 9/2014 Bianco ..... A61J 1/16 604/408
9,179,986 B2 * 11/2015 Khouri ..... A61C 7/04
2004/0220616 A1 * 11/2004 Bonutti ..... A61B 17/0487 606/232
2006/0259195 A1 * 11/2006 Eliuk ..... A61J 1/20 700/245
2007/0051425 A1 * 3/2007 Wadium ..... B65B 43/465 141/166
2007/0241151 A1 * 10/2007 Murray ..... B65B 43/465 224/407
2009/0126825 A1 * 5/2009 Eliuk ..... B65B 3/003 141/1
2011/0059832 A1 * 3/2011 Giampieri ..... B65B 43/465 493/186
2011/0303319 A1 * 12/2011 Bullard ..... A44C 27/00 140/102
2014/0227021 A1 * 8/2014 Kamen ..... A61M 5/1414 403/14
2015/0284122 A1 * 10/2015 Murray ..... B65B 43/04 248/99

* cited by examiner

*Primary Examiner* — Monica Carter
*Assistant Examiner* — Mahdi H Nejad
(74) *Attorney, Agent, or Firm* — McCarter & English, LLP

(57) ABSTRACT

A bag for pharmaceutical products is gripped by a gripping member provided with two jaws movable between a gripping position and a releasing position of the bag, with a recess obtained between the two jaws to accommodate therein at least one duct to access the content of the bag, and with a support pin protruding into the recess to allow the access duct to be folded from a substantially rectilinear, initial configuration to a final configuration, where the access duct is folded about the support element itself.

7 Claims, 3 Drawing Sheets

GRIPPING MEMBER OF A BAG FOR PHARMACEUTICAL PRODUCTS

The present invention relates to a gripping member of a bag for pharmaceutical products.

The bag is made of flexible material and is normally provided with an injection duct and with an infusion duct, which protrude upwards from an upper edge of the bag and allow to inject a pharmaceutical product into the bag and to take the pharmaceutical product from the bag itself, respectively.

BACKGROUND OF THE INVENTION

The gripping member of the type described, for example, in international patent application WO-2008012596-A2, is generally used in an automatic machine for the preparation of pharmaceutical products, and comprises two substantially flat, shaped gripping jaws hinged to each other to rotate with respect to each other about a given fulcrum axis between a clamping position and a releasing position of the bag.

The mentioned injection and infusion ducts protrude upwards from the jaws when the two jaws are arranged in their clamping position.

As the infusion duct is relatively long and longer than the injection duct, the known gripping members of the above-described type have some drawbacks mainly deriving from that the infusion duct may fold over the injection duct, thus preventing the injection duct itself from being accessed, and may interfere with the fixed parts of the automatic machine during the movements of the gripping member within the automatic machine itself.

SUMMARY OF THE INVENTION

It is the object of the present invention to provide a gripping member of a bag for pharmaceutical products which is free from the above-described drawbacks and which is simple and cost-effective to be implemented.

According to the present invention, a gripping member of a bag for pharmaceutical products is provided as claimed in the appended claims.

BRIEF DESCRIPTION OF THE DRAWINGS

The present invention will now be described with reference to the accompanying drawings, which show a non-limitative embodiment thereof, in which.

DETAILED DESCRIPTION OF THE INVENTION

Figure 1:
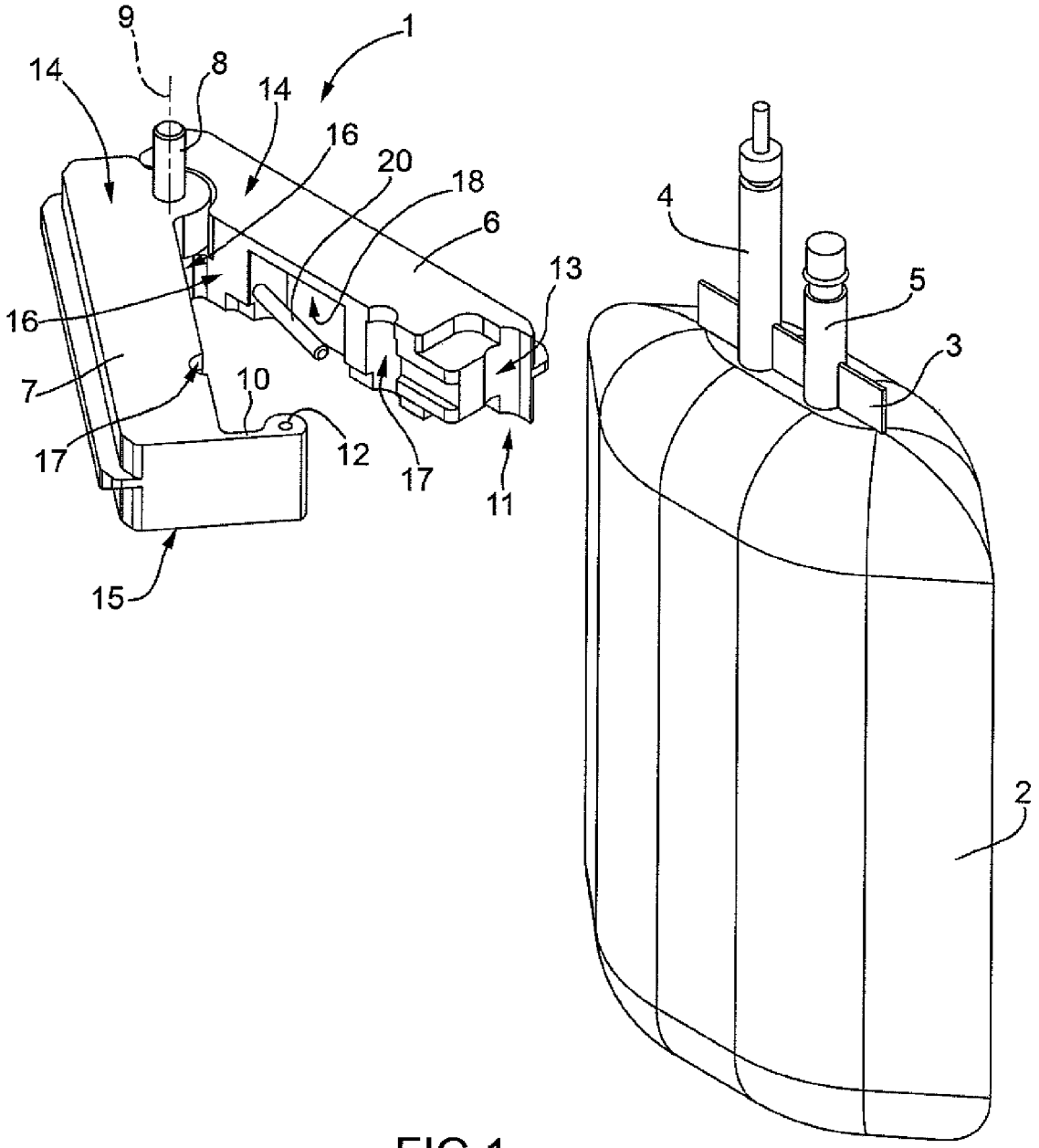
FIG. 1 is a perspective view of a preferred embodiment of the gripping member according to the present invention and of a bag.
Figure 2:
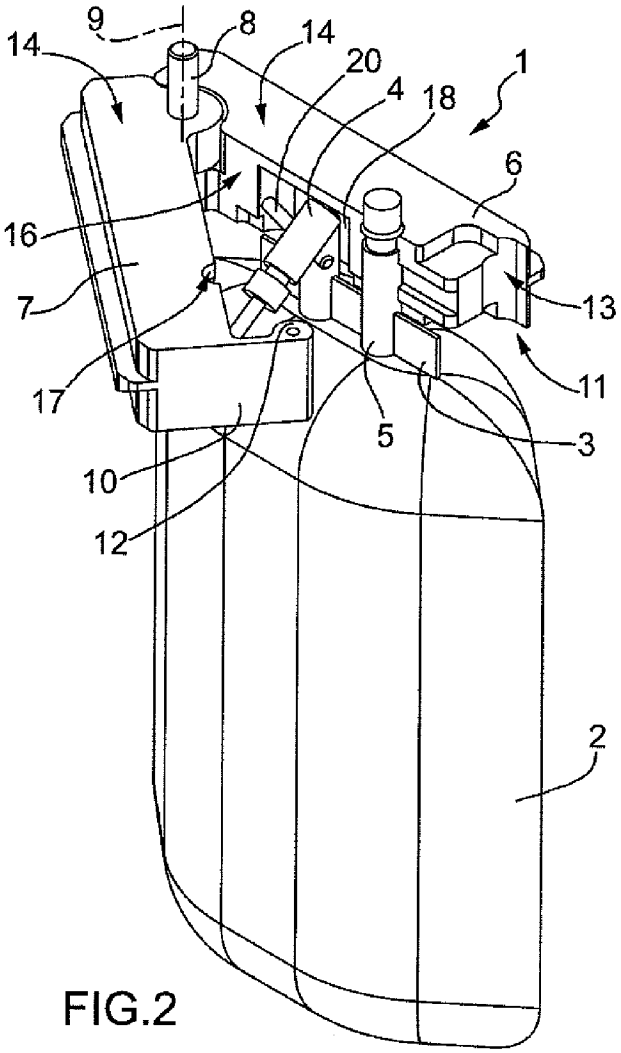

With reference to FIGS. 1 and 2, numeral 1 indicates as a whole a gripping member normally used in an automatic machine (not shown) for the preparation of pharmaceutical products in order to grip and hold a bag 2 for pharmaceutical products of the known type.

Bag 2 is made of flexible material and has a substantially flat upper edge 3 provided, in this case, with two ducts 4, 5 to access the content of bag 2, of which the duet 4 is longer than duct 5, The two ducts 4, 5 protrude upwards from edge 3, and allow to take the pharmaceutical product from bag 2 and to inject the pharmaceutical product into the bag 2 itself, respectively.

Figure 3:
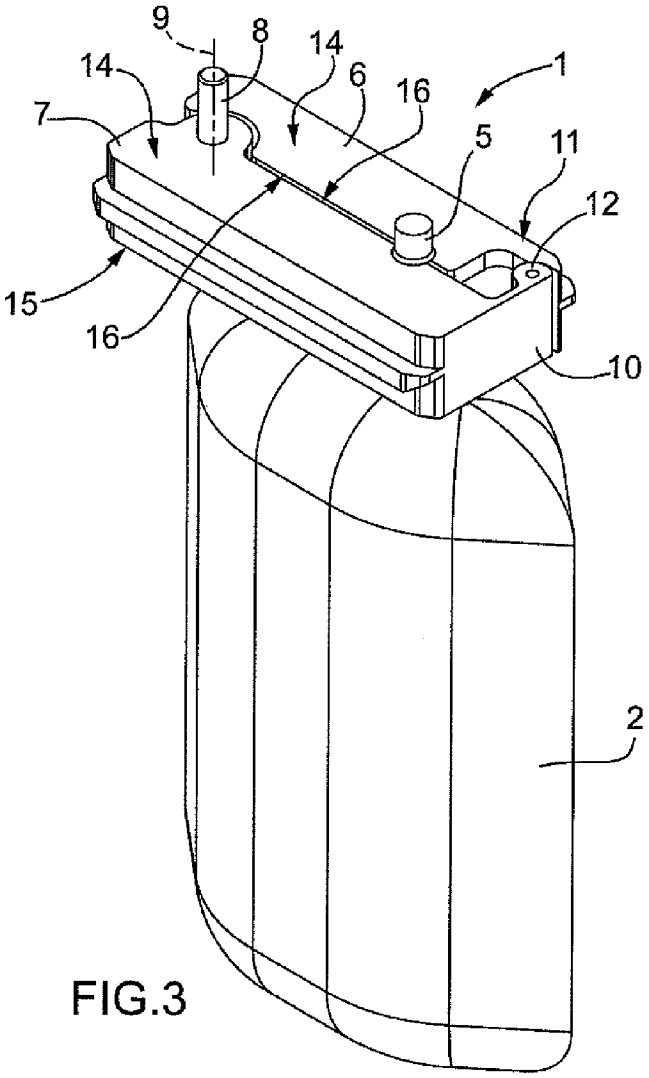
FIGS. 2 and 3 are two perspective views of the gripping member and of the bag shown in two operating positions different from that shown in FIG. 1.

The gripping member 1 comprises two flat jaws 6, 7 which are substantially rectangular in shape and hinged to each other by means of the interposition of a substantially vertical coupling pin 8 in order to rotate with respect to each other about a longitudinal axis 9 of pin 8 between a clamping position (FIG. 3) and a releasing position (FIGS. 1 and 2) of bag 2.

Jaw 7 is substantially L-shaped and provided with an elastically deformable fin 10, which extends perpendicularly from jaw 7 and protrudes towards jaw 6 from an end of jaw 7 opposite to pin 8.

The jaws 6, 7 are locked in their clamping position by means of a locking device 11 comprising a substantially cylindrical tooth 12 obtained at a free end of the fin 10, and a slot 13 which is obtained through an end of jaw 6 opposite pin 8, extends parallel to axis 9, has a circular shape, and is adapted to receive and hold tooth 12 upon a movement of the jaws 6, 7 to their clamping position.

With regards to the above description, it is worth noting that pin 8 protrudes upwards from the jaws 6, 7 to define a feeding element of the gripping member 1.

Figure 4:
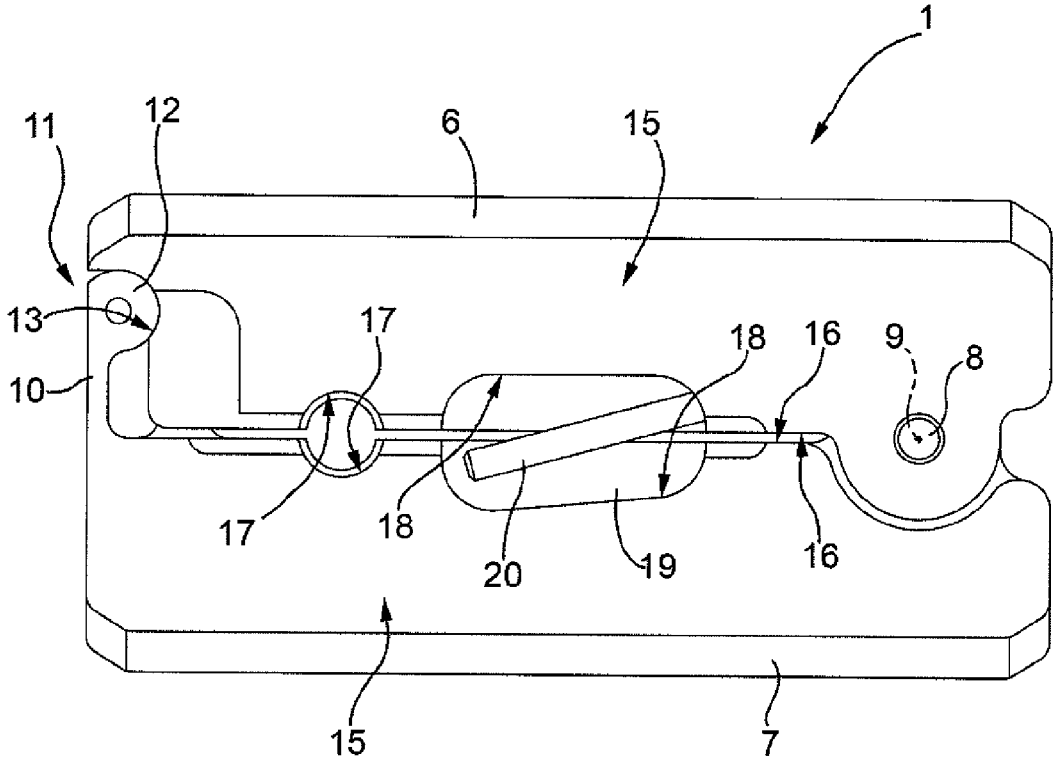
FIG. 4 is a bottom view of the gripping member in FIGS. 1, 2 and 3.

As shown in FIGS. 1, 2, and 4, each jaw 6, 7 is limited by an upper face 14 and a lower face 15 substantially parallel to each other and perpendicular to axis 9, and is further limited by a substantially flat side face 16, which extends perpendicularly to the faces 14, 15, facing the face 16 of the other jaw 6, 7.

The face 16 of each jaw 6, 7 has a substantially semi-cylindrical slot 17, which extends through the jaw 6, 7 parallel to axis 9, opens outwards at the faces 14, 15, and 16, and cooperates with the slot 17 of the other jaw 6, 7 to receive and hold duct 5 upon the movement of the gripping member 1 to its clamping position, thus allowing duct 5 to protrude upwards from the jaws 6, 7.

The face 16 of each jaw 6, 7 further has a slot 18, which opens outwards at the faces 15 and 16, and cooperates with the slot 18 of the other jaw 6, 7 to define a chamber 19 (FIG. 4) adapted to receive and hold duct 4 when the gripping member 1 is arranged in its clamping position.

Slots 18, and thus chamber 19, are longitudinally open at face 15 and are longitudinally closed at face 14.

According to a variant (not shown), slots 18, and thus chamber 19, are longitudinally open both at face 14 and at face 15.

Jaw 6 is provided with a support pin 20, which extends transversally to axis 9, protrudes into chamber 19 from a side wall of the slot 18 of jaw 6, and allows duct 4 to be folded from an initial configuration (FIG. 1), where duct 4 is substantially rectilinear and oriented upwards, to a final configuration (FIG. 2), where duct 4 is folded downwards about the pin 20 itself.

The support pin 20 allows duct 4 to be folded within chamber 19, so as to prevent duct 4 from protruding upwards from the jaws 6, 7, from interfering with the fixed parts of the mentioned automatic machine (not shown) during the movements of the gripping member 1 within the automatic machine (not shown) itself, and from folding over duct 5, thus preventing the duet 5 itself from being accessed.

The invention claimed is:

1. A gripping member of a bag (2) for pharmaceutical products, the bag (2) having at least a first duct (4) to access the content of the bag (2), the gripping member comprising two jaws (6, 7), which are movable between a clamping position and a releasing position of the bag (2), and a first recess (19) obtained between the jaws (6, 7) to accommodate, in use, the first access duct (4); and being characterized in that it further comprises a support element (20), which protrudes into the first recess (19), so as to allow the first access duct (4) to be folded from an initial configuration, where the first access duct (4) is substantially rectilinear, to a final configuration, where the first access duct (4) is folded about the support element (20) and inside the first recess (19);

wherein each said jaw (6, 7) is limited by an end face (16) facing the other said jaw (6, 7), and comprises a slot (18), which opens outwards at the corresponding end face (16), and defines the first recess (19), together with the slot (18) of the other said jaw (6, 7), the first recess (19) adapted to receive and hold the folded first access duct (4) when the two jaws (6, 7) are in the clamping position; and wherein the support element (20) comprises a pin protruding into the first recess (19) from a side wall of the slot (18) of one of the jaws (6, 7);

wherein each said jaw (6, 7) is delimited by an upper face (14) and by a lower face (15), which are substantially parallel to each other, the corresponding slot (18) being longitudinally open at the lower face (15) and longitudinally closed at the upper face (14), the longitudinally closed upper faces (14) thereby preventing the first access duct (4) from extending upwardly above upper faces (14) when the first access duct (4) is folded about the support element (20) and the two jaws (6, 7) are in the clamping position.

2. The gripping member according to claim 1, wherein the two jaws (6, 7) are pivotally coupled to each other, so as to rotate with respect to each other about a fulcrum axis (9); the support element (20) comprising the pin protruding into the first recess (19) transversally to the fulcrum axis (9) itself.

3. The gripping member according to claim 1, wherein the two jaws (6, 7) are shaped so as to further define a second recess (17) adapted to accommodate a second duct (5) to access the content of the bag (2), when they are arranged in their clamping position.

4. The gripping member according to claim 1 and further comprising a locking device (11) to lock the two jaws (6, 7) in their clamping position.

5. The gripping member according to claim 4, wherein the locking device (11) comprises an elastically deformable tooth (12) obtained in said first jaw (6, 7) and a further slot (13) obtained in said second jaw (6, 7), so as to receive and hold the tooth (12) upon a movement of the jaws (6, 7) to their clamping position.

6. The gripping member according to claim 5, wherein the first jaw (6, 7) is substantially L-shaped, and comprises an elastically deformable fin (10), which protrudes perpendicularly to the first jaw (6, 7) to define said tooth (12).

7. The gripping member according to claim 1 and further comprising a hooking device protruding from said jaws (6, 7), so as to allow the gripping member to be moved.

* * * * *